United States Patent [19]

Hodes

[11] 4,239,121

[45] Dec. 16, 1980

[54] VITAMIN ORGANIZER

[76] Inventor: Martin Hodes, 53-54 207th Street, Bayside, N.Y. 11364

[21] Appl. No.: 32,561

[22] Filed: Apr. 23, 1979

Related U.S. Application Data

[63] Continuation-in-part of Ser. No. 931,170, Aug. 4, 1978, abandoned.

[51] Int. Cl.[3] ..... B07C 7/00

[52] U.S. Cl. ..... 209/703; 133/1 R; 133/3 R

[58] Field of Search ..... 209/702, 703; 133/1 R, 133/3 R

[56] References Cited

U.S. PATENT DOCUMENTS

| | | | |
|---|---|---|---|
| 697,108 | 4/1902 | Smith | 133/3 R |
| 3,238,953 | 3/1966 | Barbie | 133/3 R |
| 3,332,430 | 7/1967 | Busch | 133/3 R |
| 3,338,250 | 8/1967 | Mehelich | 133/3 R |

*Primary Examiner*—Joseph J. Rolla

*Attorney, Agent, or Firm*—McAulay, Fields, Fisher, Goldstein & Nissen

[57] ABSTRACT

A nutritional supplement organizer for quantizing, in individual containers, complete daily supplement requirements composed of one or more individually prepared tablets, capsules, or other dosage forms, has a base, a guide slot for guiding the individual dosage forms into containers disposed below the guide slots, and a support structure for supporting the guide slots on the base and in pre-determined spaced apart relation to the base in orer to permit the containers to be inserted in the organizer below the guide slots.

1 Claim, 8 Drawing Figures

VITAMIN ORGANIZER

RELATED APPLICATIONS

This application is a continuation-in-part of application Ser. No. 931,170 filed Aug. 4, 1978, now abandoned.

BACKGROUND OF THE INVENTION

With an increasing awareness of the body's nutritional needs has come the recognition that each individual has different nutritional requirements depending on his or her particular daily activities, his or her usual diet, and the general condition of his or her body. Although decisions with respect to an individual's nutritional needs are normally made with the advice of skilled practitioners or doctors, it is usual that the supplemental nutritional intake is self-administered and is in the form of commercially available pre-packaged dosages, such as pills, capsules, or the like.

Because one must usually depend on commercially available nutritional supplements in commercially available dosages, it is necessary to take varying numbers of individually available dosages in order to administer appropriate dosage levels as well as appropriate mixtures of nutritional substances. In addition, the amount and the type of nutritional supplements which are taken over a period of time may vary from day to day. It is therefore not only necessary to programme ones nutritional intake, but to keep a record of day-to-day dosages in order that the programme be properly utilized.

It is usual that one merely keep track of the various dosages by memory or by keeping a written record so that as each day progresses the appropriate number and kind of commercially available dosages are ingested on schedule. Often this regimen may be repeated several times a day.

It is therefore an object of the present invention to provide a vitamin organizer which permits convenient quantization of a complete nutritional dosage requirement in an individual container.

It is a related object of the invention to provide a vitamin organizer which permits quantizing complete nutritional dosages conveniently for a predetermined period of time, especially for one or two weeks, so that variations in the dosages for the extended period of time can be pre-programmed and the dosages thereafter taken in specific order without the inconvenience of referring to a programme time-table.

It is a further object of the invention to provide an inexpensive and easily operated vitamin organizer which can be utilized conveniently by the ultimate consumer of the nutritional supplements.

BRIEF DESCRIPTION OF THE DRAWINGS

Reference is now made to the drawings wherein.

DESCRIPTION OF THE PREFERRED EMBODIMENT

Figure 1:
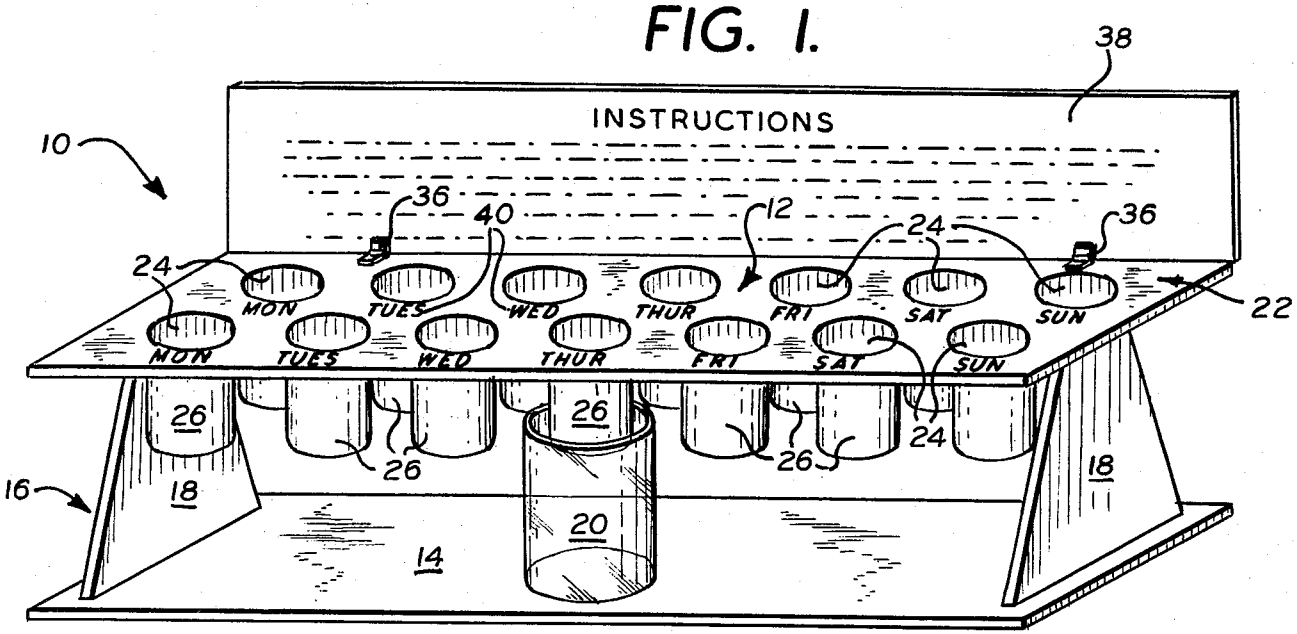
FIG. 1 is a perspective view of a vitamin organizer according to the present invention with one container in place for receiving nutritional supplements

With reference to FIG. 1, a vitamin organizer comprises a guide means 12, a base 14 and a support structure 16 composed of two upright sides 18, which support the guide means 12 on the base 14, in a pre-determined spaced apart relationship whereby containers 20 will fit under the guide means 12 to be filled.

Figure 2:
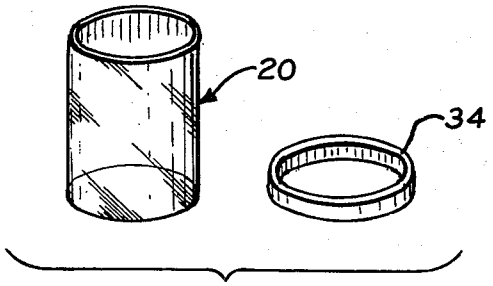
FIG. 2 is a perspective view of a rigid material container, and cap therefore, of the type shown in place in FIG. 1.

The guide means 12 is formed of a generally flat rigid member 22 having openings 24 formed therethrough. Each opening 24 has a guide sleeve 26 extending downwardly therefrom and operable to extend into one of the containers 20 in order that dosages dropped through the openings 24 will be guided into the containers 20. When a rigid container 20, such is shown in FIG. 2, is utilized, the guide sleeve 26 may be a simple cylindrical form such as is shown in FIG. 1. If it is desired to use a flexible bag-like container such as container 28 shown in FIG. 3, it is preferable that a modified guide sleeve 30 be utilized. Modified guide sleeve 30 is similar in structure to guide sleeve 26 except that its lower portion includes an expanded lip 32 in order that the flexible bag-like container 28 be supported thereon.

Rigid containers 20 will normally be fitted with a cap 34, shown in FIG. 2 while the flexible bag-like containers 28 may be closed by any usual means such as a rubber band, or a formed inter-locking lip (not shown).

With reference to FIGS. 4 through 8, the Vitamin Organizer 10′ comprises a guide means 12′, a base 14′ and a support structure 16′ composed of a cylindrical wall 18′ which supports the guide means 12′ above the base 14′ in a predetermined spaced apart relationship, whereby containers 20′ will fit beneath the guide means 12′ to be filled (FIG. 1).

Figure 4:
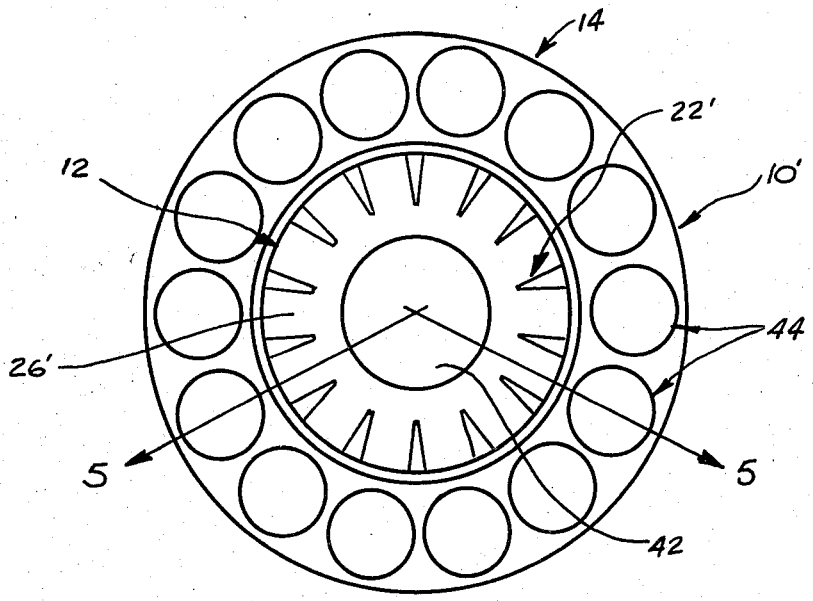
FIG. 4 is a top plan view of second embodiment of a vitamin organizer according to the present invention.
Figure 6:
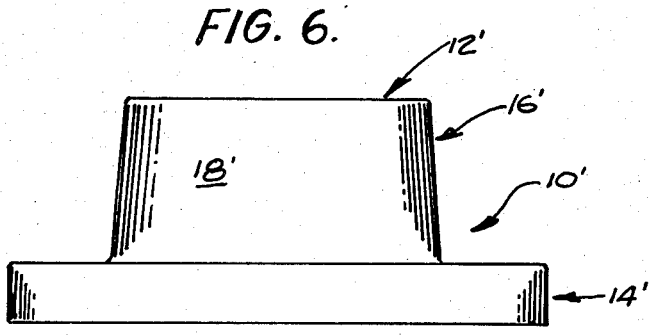
FIG. 6 is an elevational view of the Vitamin Organizer of FIG. 4.
Figure 5:
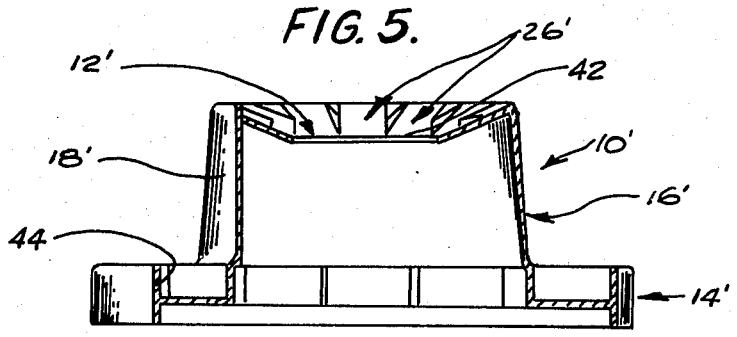
FIG. 5 is a section view through 5—5 of FIG. 4.
Figure 7:
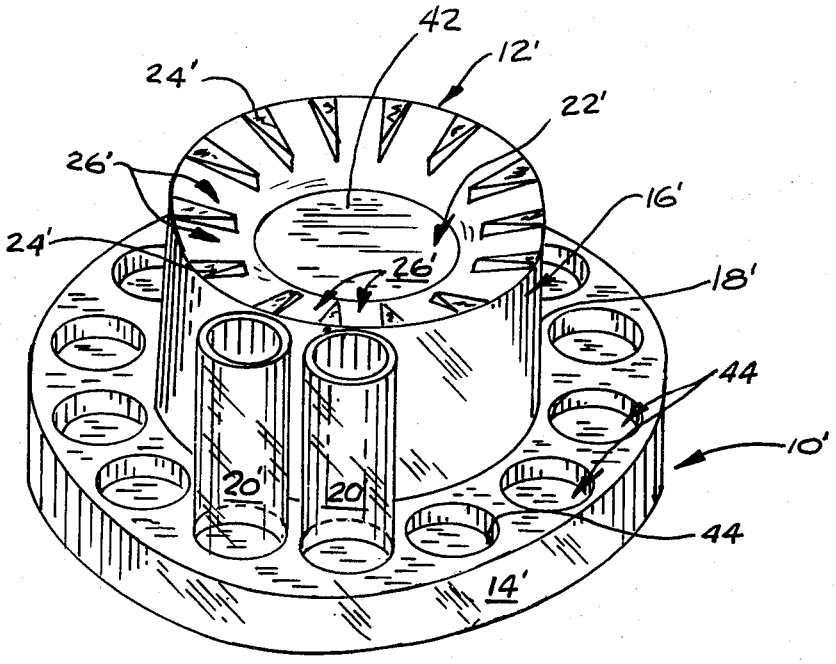
FIG. 7 is a perspective view thereof.

A guide means 12′ is in the form of a generally concave member 22′ having raised guide walls 24′ defining guide slots 26′ (FIGS. 4, 5 and 7). The guide slots 26′ extend from a central supply reservoir 42 of the concave member 22′ to the edge of the concave member 22′. The reservoir 42 is operable to hold a supply of various capsules or tablets or the like, as is clear from FIGS. 5 and 7.

The base 14′ has sockets 44 formed therein to receive containers 20′. Containers 20′ are generally similar to containers 20 shown in FIG. 2, but have been sized to fit the organizer 10′ of FIG. 7. As can be seen in FIG. 7, the containers 20′ are received in sockets 44 and extend upwardly therefrom to a point near the upper edge of cylindrical wall 18′. The sockets 44 are so disposed with respect to guide slot 26′ that the containers 20′ are supported positioned under the outer end of the guide slots 26′. This relationship ensures that dosages moved from the reservoir 42 along guide slots 26′ will drop into containers 20′. That the containers 20′ extend up to, or substantially up to the outer edge of the guide slots 26′ is a presently preferred embodiment for the containers 20′. However, it will be obvious that the device will work with containers of any height as long as they do not extend substantially above the edge of the guide slot 26' to block the entrance of dosages into the containers 20'.

Figure 8:
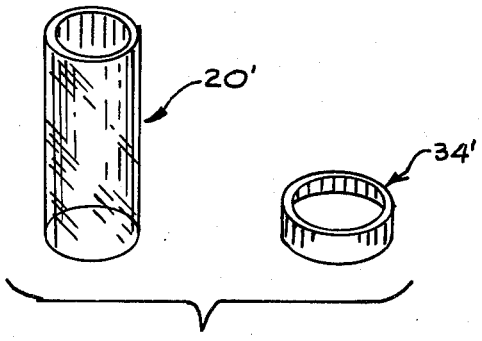
FIG. 8 is a perspective view of a rigid material container similar to that shown in FIG. 2 but modified in size for the organizer of FIG. 7.

As shown in FIG. 8, it is convenient to provide the container 20' with a cap 34' whereby, one feature container 20' has received the desired dosages, it may be sealed until the dosages are to be removed therefrom.

Operation of the Device

The operation of the various embodiments of the device is simple and straight-forward.

Figure 3:
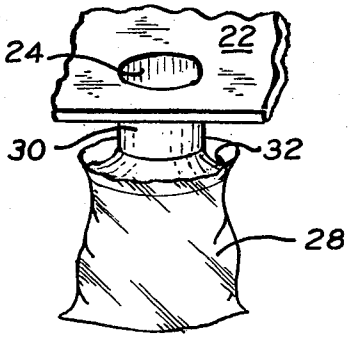
FIG. 3 is a perspective partial view of a modification of the vitamin organizer of FIG. 1 showing a guide sleeve with an expanded lower lip for receiving a flexible bag-type container, and such a container in place thereon.

With reference to the embodiments of FIGS. 1 through 3, suitable containers such as rigid containers 20, are placed under each guide sleeve 26. If a flexible bag-like container 28, as shown in FIG. 3, is utilized, the bag is slipped over the expanded lip 32 of guide sleeve 30 whereby it is supported thereon. Thereafter the required or desired nutritional dosage for each individual intake is dropped into an appropriate opening 24 and directed by guide sleeve 26 into the container.

It is preferable to index each opening with, for instance, the day of the week or other index 40. It is also convenient that each container include a corresponding index so that the user will know which container contains the next appropriate dosage of nutritional supplements.

The embodiment of FIGS. 4 through 8 is somewhat simpler and faster to operate than the various embodiments of FIGS. 1 through 3. Suitable containers such as rigid containers 20' are inserted in sockets 44, as shown in FIG. 7. Thereafter, a supply of dosages of nutritional supplements or other small dosages, is put into the reservoir 42. Individual dosages can then be moved along guide slots 26' into appropriate containers, most simply by using a finger. This simple procedure allows distribution of the various dosages into the appropriate containers quite rapidly.

After the first dosage has been distributed, the excess ones are removed from the reservoir 42 and a second dosage may be distributed in the same manner, if desired.

The above is intended as an illustration, only, of the presently preferred embodiments of the present invention, as other modifications would be obvious to a person of ordinary skill in the art. For example, devices shaped differently than those shown in the figures, for example, a U-shaped device turned sideways so that one arm is the base and the other arm carries the guide means in a manner analogous to the device shown in FIG. 1, is an embodiment which would be within the spirit of the invention. The scope of the invention should therefor be limited only as is defined in the claims as follows:

What is claimed is:

1. A vitamin organizer for quantizing, in individual containers, complete nutritional dosage requirements in the form of one or more commercially prepared tablets, capsules or other dosage forms, comprising:

a base;

a guide means for guiding the individual dosage forms into containers disposed below said guide means; and a support structure for supporting said guide means on said base and in predetermined spaced apart relation to said base, to permit the containers to be inserted in said organizer below said guide means;

said guide means comprising a generally circular concave disk, a dosage reservoir defined in the central portion of said concave disk, and a plurality of guide slots formed radially outwardly from said reservoir to the edge of said guide means to guide dosages moved from said reservoir through said guide slots into a container supported below the edge of said guide means;

said base comprising a generally circular disk having sockets formed therein to receive and hold the containers into which dosages are to be delivered, and sockets being disposed circumferentially around said base and generally below the end of said guide slots.

* * * * *